US006266882B1

(12) United States Patent
Ali et al.

(10) Patent No.: US 6,266,882 B1
(45) Date of Patent: Jul. 31, 2001

(54) FIN COLLAR AND METHOD OF MANUFACTURING

(75) Inventors: Amer F. Ali, E. Syracuse; Michael P. McCabe; Daniel P. Gaffaney, both of Chittenango, all of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/315,103

(22) Filed: May 20, 1999

(51) Int. Cl.[7] ..... B23P 15/26
(52) U.S. Cl. ..... 29/890.046; 29/890.03
(58) Field of Search ..... 29/890.03, 890.046, 29/890.043, 523, 521

(56) References Cited

U.S. PATENT DOCUMENTS 3,216,095 * 11/1965 Kurtz et al. ..... 29/890.046
3,519,070 * 7/1970 Bappler ..... 29/890.046
5,282,313 * 2/1994 Podhorsky et al. ..... 29/890.046
5,582,246 * 12/1996 Dinh ..... 29/890.046

* cited by examiner

*Primary Examiner*—I Cuda Rosenbaum

(57) ABSTRACT

A method for forming an heat exchanger fin collar for a plate-fin heat exchanger having close tolerance dimensions for achieving greater contact area on the tube. The fin collar includes an elongated fin portion for dissipating heat and a leg connected with the fin portion. The leg has a height and includes a straight contact portion substantially perpendicular to the fin portion, wherein the contact portion has a contact height along which the contact portion contacts the tube. The height is in the range of 0.008 to 0.080 inches. It also includes a first curved end portion having a first radius extending from a first end of the contact portion and a stepped transitional portion connecting the contact portion and the elongated fin portion. The transitional portion has a second curved end portion having a second radius, wherein the second curved end portion extends from the contact portion opposite the first end.

22 Claims, 5 Drawing Sheets

FIN COLLAR AND METHOD OF MANUFACTURING

TECHNICAL FIELD

This invention is directed to heat exchanger fin collars, and more particularly, to an improved method for manufacturing the fin collars to have an extended tube-contact portion, for improved heat exchange efficiency and better galvanic corrosion durability.

BACKGROUND OF THE INVENTION

Plate-fin coil air-side surfaces are formed in progressive dies. There are several variants of these dies which include draw forming, drawless forming, fin-per stroke, and high collar dies. For each method, a primary consideration is the formation of the tube contact cylinder of the fin collar, which is used as the contact area between the fin collar and the heat exchanger tube. From both thermal performance and corrosion durability perspectives, a greater contact area is advantageous. Also, for many applications a high fin density is desirable. Therefore, it is preferable to have a large number of fin collars with a relatively small size contact leg, but with a large percentage of the contact leg in contact with the heat exchanger tube. Also, the manufacturing process should be flexible in making fin sizes for a wide range of fins per inch and capable of producing a good and repeatable collar geometry. Current methods fail to adequately achieve these goals. As represented in FIGS. 4 and 4*a*, most fin collars formed in accordance with prior art methods have tube-contact legs which only contact the tube surface over a very short distance, essentially at the apex of the contact leg's radius.

For a coil made with bare finstock, a relatively small contact area between fin and tube will provide thermal transport with minimal thermal resistance. However, if the finstock has an organic film or other coating with a significant thermal resistance, a larger contact area provides substantially improved performance.

With current practices, while the length of the contact leg is somewhat adjustable or flexible, based on the ability to perform multiple drawing stages, the resulting contact leg is frequently not formed sufficiently straight. The limitations of various current fin forming methods can be seen by referring to FIG. 5. The fin collar formed from this method includes contact legs that are curved and do not effectively cover the surface of the heat exchanger tube, as shown in FIG. 4*a*, thereby inefficiently contacting the tube surface and accordingly, failing to achieve the best heat exchange relationship therewith.

More specifically, in the draw forming method of FIG. 5*a*, a sheet or strip of fin stock material is formed with a button therein. The height or depth of the button may be increased or decreased to adjust the fin density and the length of the fin collar contact leg. Accordingly, a number of drawing stages are used to shape the contact leg of the fin collar. The button is then pierced and the fin collar is shaped, straightened and flared for forming the desired contact leg. Corrosion durability of an aluminum fin/copper tube heat exchanger is inversely proportional to the exposed area of the copper tube in the fin pack of the coil. This is because the primary corrosion mechanism for these heat exchangers is galvanic corrosion. Reducing the cathodic copper area proportionally decreases the corrosion current. In addition, improving the straightness of the collar contact area decreases access of electrolyte to the copper/aluminum contact area of the galvanic couple. More complete coverage of the tubes by the aluminum collar improves corrosion durability. The amount of electrolyte that can be stored in the collar crevice is also a function of the collar design. The reduction in the electrolyte content proportionately reduces the galvanic current.

The drawless forming method of FIG. 5*b* begins with a piercing and burling step and thereby lacks the multiple drawing stages of the draw forming method and, accordingly, lacks the flexibility of adjusting the contact leg length. In the first step, fin stock is pierced and buried to form a pre-contact leg. The pre-contact leg is ironed for straightening and limited lengthening and finally, the tip of the leg is flared or curled. Accordingly, this method lacks the flexibility of adjusting the contact leg length. Similarly, the single shot method shown in FIG. 5*c* also lacks flexibility, starting with a piercing step, then a burling step to bend and form the pre-contact legs, and finally a flaring step for flaring or curling the ends of the contact legs. The high fin method of FIG. 5*d* has substantially the same steps as the draw forming method with additional ironing steps between the piercing and burling and flaring steps so as to somewhat improve the straightness of the contact leg. However, the high fin method suffers from the same defects or shortcomings as the draw forming method, described above.

There exists a need, therefore, for an improved fin collar forming method whereby the fin collar is formed with a substantially straight contact leg and greater contact area and whereby the method has the flexibility to provide for any desired length of the contact leg while maintaining its straightness as well as good physical and material characteristics.

DISCLOSURE OF THE INVENTION

The primary object of this invention is to provide an improved method for manufacturing heat exchanger fin collars and an improved fin collar design.

Another object of this invention is to provide an improved heat exchanger fin collar which has a substantially straight contact leg and greater contact area between the fin collar and the tube, for a high level of heat exchanger tube contact.

Another object of this invention is to provide an improved method for manufacturing a heat exchanger which provides for more complete coverage of the copper tubes and thus yields heat exchangers with improved corrosion durability.

Still another object of this invention is to provide an improved method for manufacturing heat exchanger fin collars, wherein the method allows for flexibility in the length of the fin collar and a greater tube-contact leg to achieve greater contact area between the fin collar and the tube.

Yet another object of this invention is to provide a method for forming heat exchangers which reduce the amount of potential electrolyte volume between the fin collar and the tube-contact leg.

The foregoing objects and following advantages are achieved in part by the heat exchanger fin collar of the present invention, for plate-fin collar style heat exchanger having close tolerance dimensions for achieving greater contact area on the tube. The fin comprises an elongated fin portion for dissipating heat and a leg connected with the fin portion. The leg has a height and includes a straight contact portion substantially perpendicular to the fin portion, wherein the contact portion has a contact height along which the contact portion contacts the tube. The contact height is in the range of 0.008 to 0.080 inches for a fin density range of 25 to 10 fpi. It also includes a first curved end portion having a first radius extending from a first end of the contact portion and a stepped transitional portion connecting the contact portion and the elongated fin portion. The transitional portion has a second curved end portion having a second radius, wherein the second curved end portion extends from the contact portion opposite the first end.

The foregoing objects and following advantages are further achieved by the method of the present invention for manufacturing a heat exchanger with a tube and a fin collar having an elongated fin portion, a contact leg, a transition portion connecting the contact leg and the fin portion, and a curved contact leg tip. The steps include: providing a tube; forming a button in the fin collar stock; piercing the stock and forming a first working member including a pre-fin portion and a pre-contact leg having a first end with a tip; extruding the first working member and substantially straightening the pre-contact leg; finally straightening the pre-contact leg by pushing the pre-contact leg into tooling for forming the fin collar with a contact leg having a straight tube-contact portion and a curved tip portion; expanding the tube to form an interference fit with the fin collars for attaching a plurality of the fin collars to the tube; and reducing the likelihood of galvanic corrosion between the tube and the plurality of fin collars by substantially abutting the straight contact portions of the plurality of fin collars on the tube for reducing atmospheric exposure of the tube.

BEST MODE FOR CARRYING OUT THE INVENTION

Figure 1A:
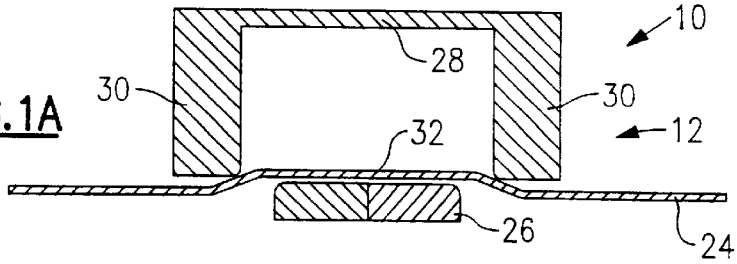
FIG. 1 is a schematic representation of the method of the present invention for forming improved heat exchanger fin collars.
Figure 1B:
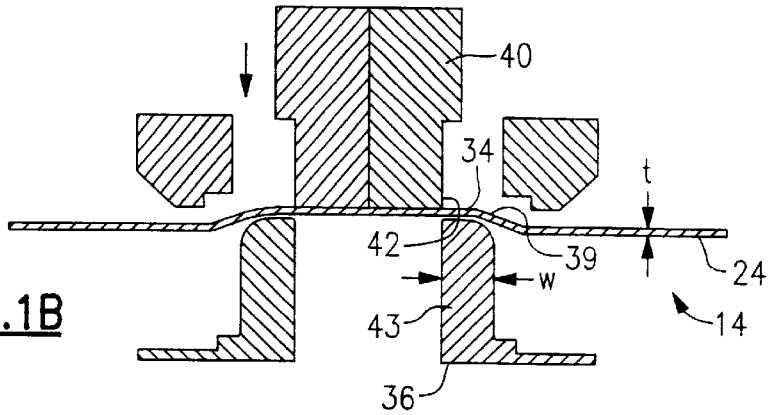
Figure 1C:
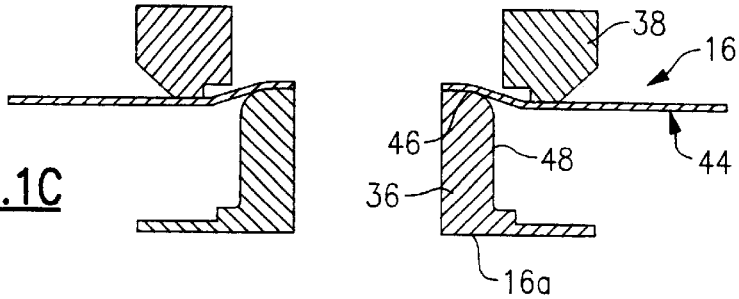
Figure 1D:
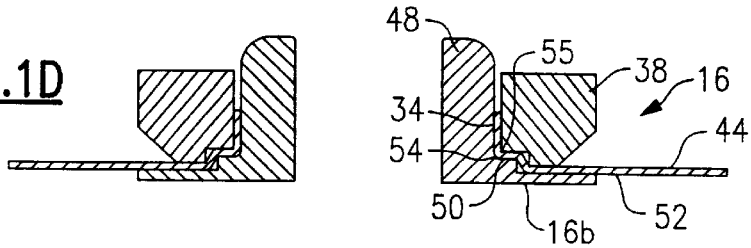
Figure 1E:
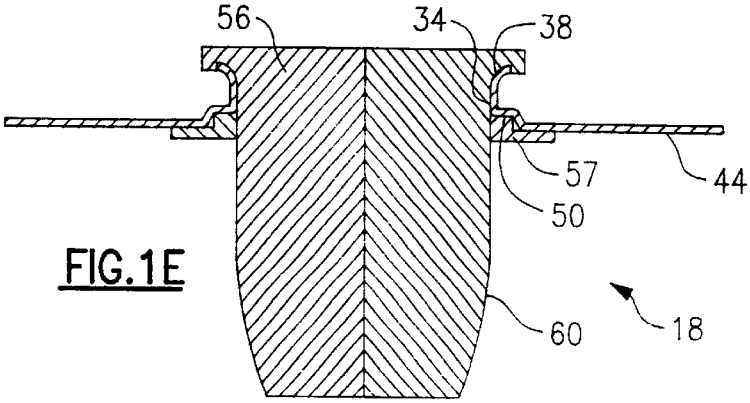

Referring now to the drawings in detail, there is shown in FIG. 1 a schematic representation of the fin collar forming method and tooling of the present invention, designated generally as 10. The method generally includes 4 steps, the button forming step 12, the piercing step 14, the extruding steps 16, and the reflaring step 18. Each of the tooling elements shown in steps 14, 16, and 18 are cylindrical in shape.

Figure 2:
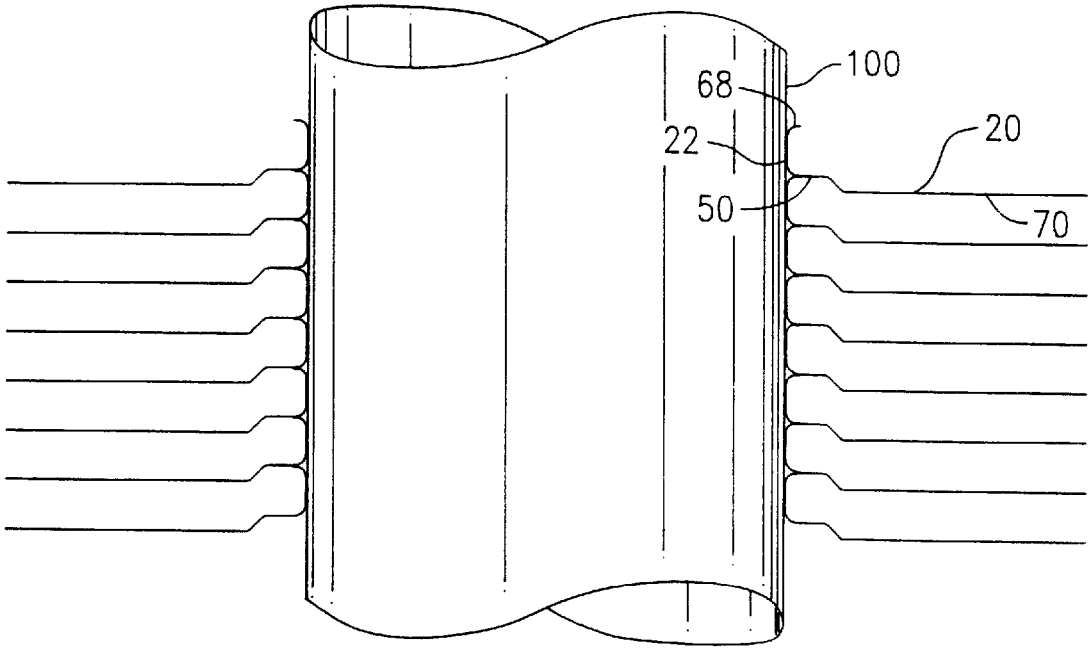
FIG. 2 is a cross-sectional view of fin collars formed in accordance with the principles of the present invention, attached to a heat exchanger tube.
Figure 2A:
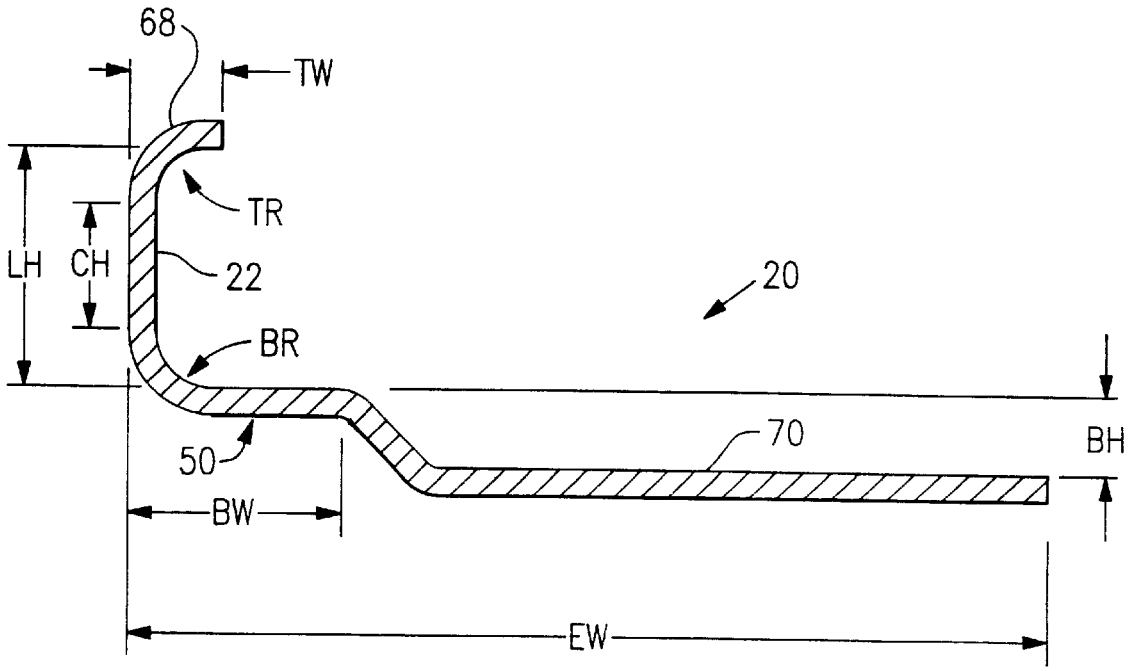
FIG. 2*a* is an enlarged view if the fin collars of the present invention, shown in FIG. 2.
Figure 4:
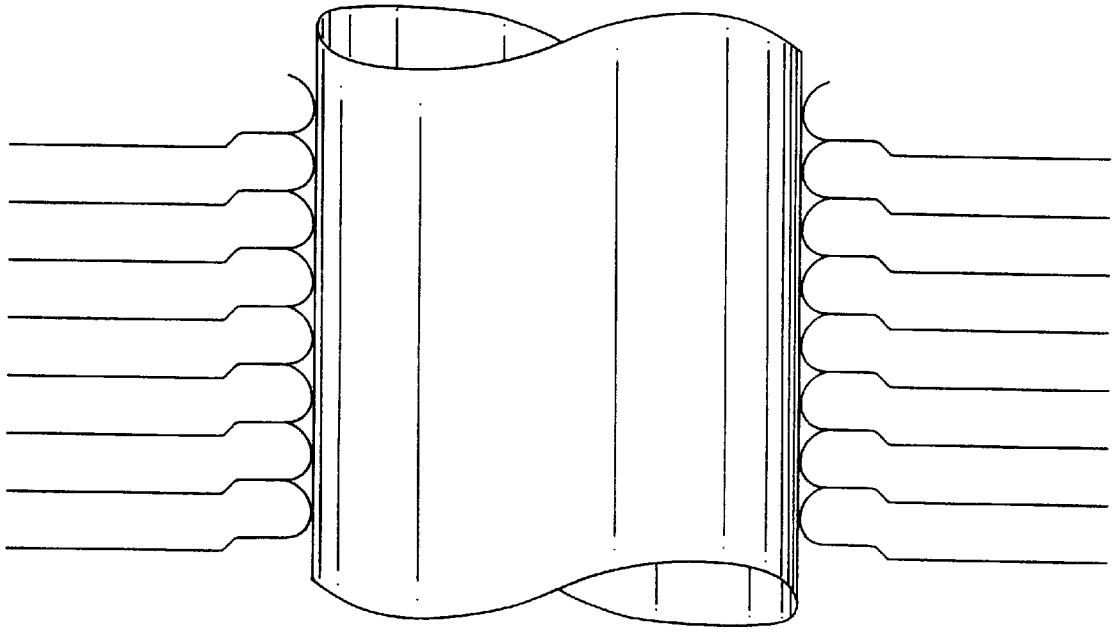
FIG. 4 is a cross-sectional view of fin collars attached to a heat exchanger tube formed in accordance with the principles of the prior art.
Figure 4A:
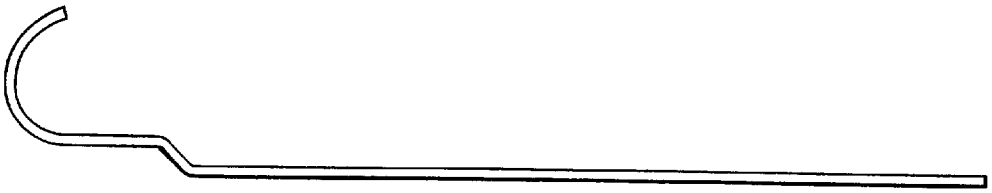
FIG. 4*a* is an enlarged view of the prior art fin collars shown in FIG. 4.
Figure 5A:
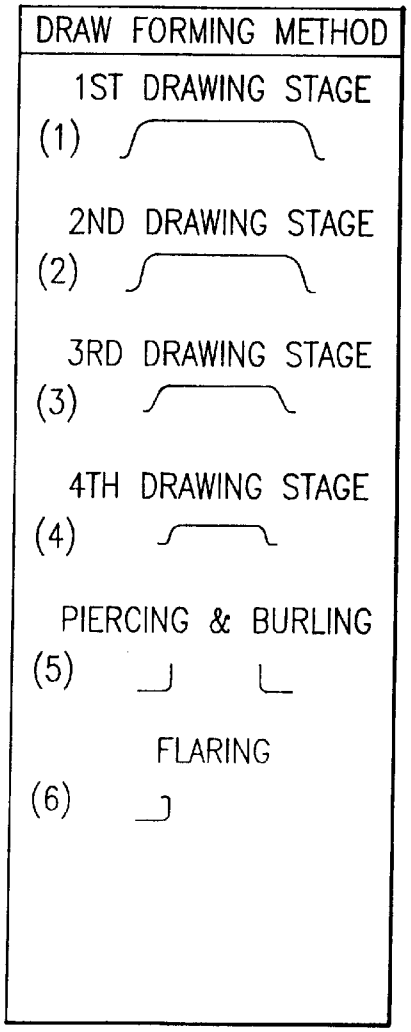
FIGS. 5*a*–5*d* are schematic representations of prior art methods for forming heat exchanger fin collars.
Figure 5B:
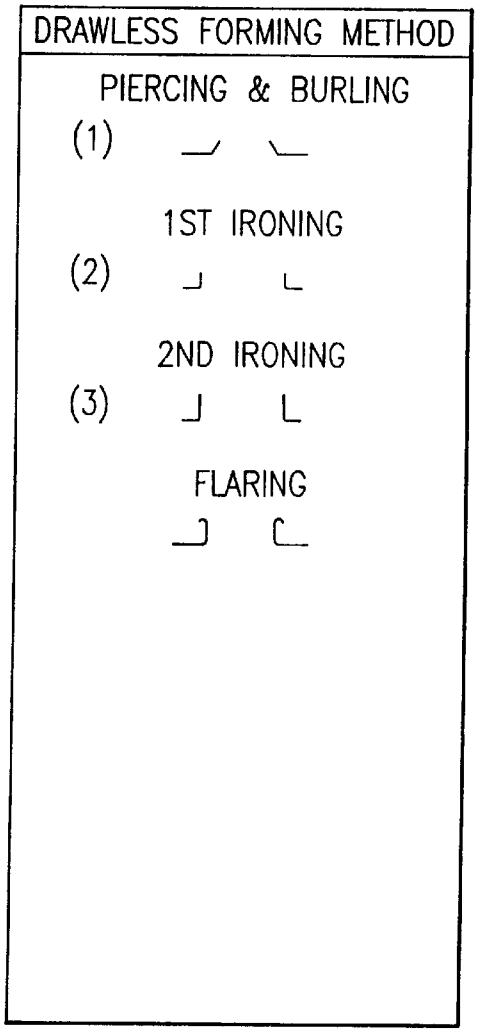
Figure 5C:
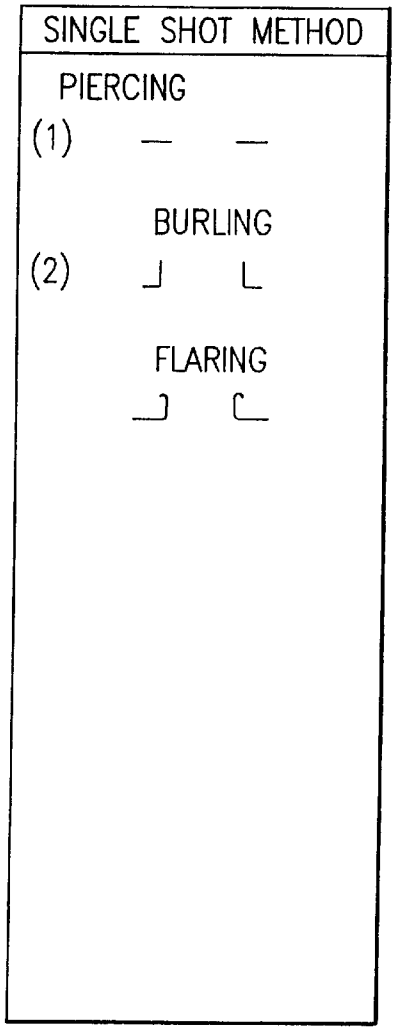
Figure 5D:
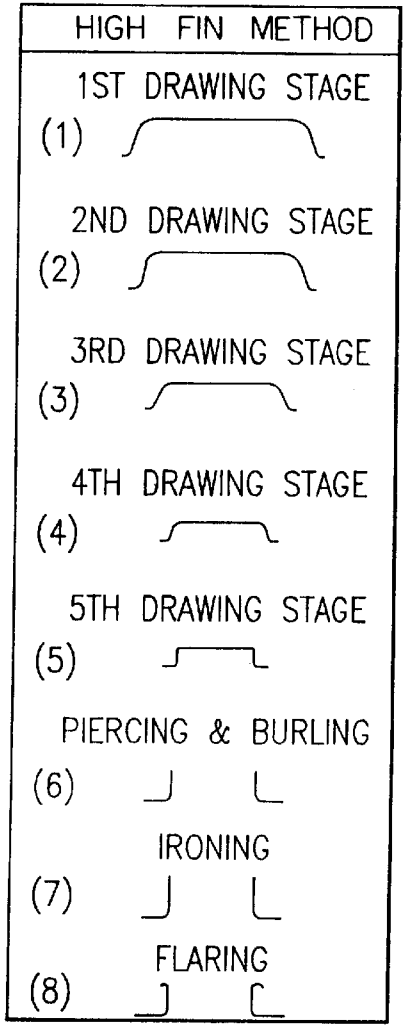

In accordance with the process set forth in FIG. 1 and as discussed below, fin collars 20, as shown in FIG. 2 attached to a heat exchanger tube 100, are formed. Each of the fin collars 20 formed from the process 10 of the present invention have a substantially straight tube contact leg 22 which, as shown in FIG. 2*a*, has a substantially straight surface portion in contact with tube 100. The fin collars 20 are described in more detail below and throughout the method description. Fin collars 20 are an improvement over fin collars of the prior art which, as shown in FIGS. 4 and 4*a*, contact the tube's surface over a much smaller surface area due to the more curved profile of the tube contact leg thereof, as a result of the prior art forming processes of FIGS. 5*a*–5*d*. Based on the closer or improved tolerance process of the present invention described in detail below, substantially more tube to fin collar contact is made allowing for improved heat exchange efficiency and improved corrosion durability.

Referring back to FIG. 1, in the button forming step 12 of the present invention, the fin stock 24 is placed on top of a bottom support 26. The top bushing 28 moves down on fin stock 24 via arm 30, deforming fin stock 24 and forming a button 32 in substantially the center thereof. The fin stock then moves on to the piercing step 14.

In piercing step 14 a pre-contact leg 34 is formed for further processing. During the piercing step, the bottom extrusion bushing 36 provides upward support on fin stock 24, opposing top extrusion bushing 38 pushing downwardly on fin stock 24, as shown. The corner 39 of the button formed above rests on the corner of button extrusion bushing 36. The width of bottom extrusion bushing 36 substantially defines the length of pre-contact leg 34. Accordingly, the width of bottom extrusion bushing 36 can be varied depending upon the desired contact length of the contact leg. In furtherance of step 14, piercing punch 40 moves in a direction as indicated, which is opposed by bottom extrusion bushing 36, pushing fin stock 24 against bushing 36.

Again, bottom extrusion bushing 36 opposes bushing piercing punch 40 on a surface area of fin stock 24 substantially equivalent to the desired length of the contact leg of the fin collar. Cutting edge 42 of piercing punch 40 moves substantially parallel to the bottom extrusion bushing 36 and downward, cutting fin stock 24 into pre-fin collar 44, as shown in extrusion step 16.

In step 16, specifically 16a, with button comer 39, which partially defines pre-contact leg 34, resting atop and being supported by curved edge 46 of the bottom extrusion bushing 36, the top extrusion bushing 38 pushes downwardly on pre-fin collar 44, close to bottom extrusion bushing 36. The downward pushing of pre-fin collar 44 while dragging pre-contact leg 34 against straightening surface 48 thereby straightens pre-contact leg 34, as shown in step 16*b*. As top extrusion bushing 38 continues downwardly, a transition portion 50 is formed between pre-contact leg 34 and pre-fin portion 52. Bottom extrusion bushing 36 includes a stepped surface 54 against which pre-fin collar 44 is pushed by top extrusion bushing 38, partially by radiused comer 55 thereof. The radius of comer 55 is carefully selected in consideration of the desired straight length of contact leg 22. Pre-fin collar 44 is then removed from the bottom and top fixtures, bushings 36 and 38 respectively, and placed onto reflare anvil 57, which has an L shaped profile, 90° rotated, with an elongated portion 59 and a thickened vertical portion 61, where reflare punch 56 enters in contact with the anvil and collar as shown in step 18.

Figure 3A:
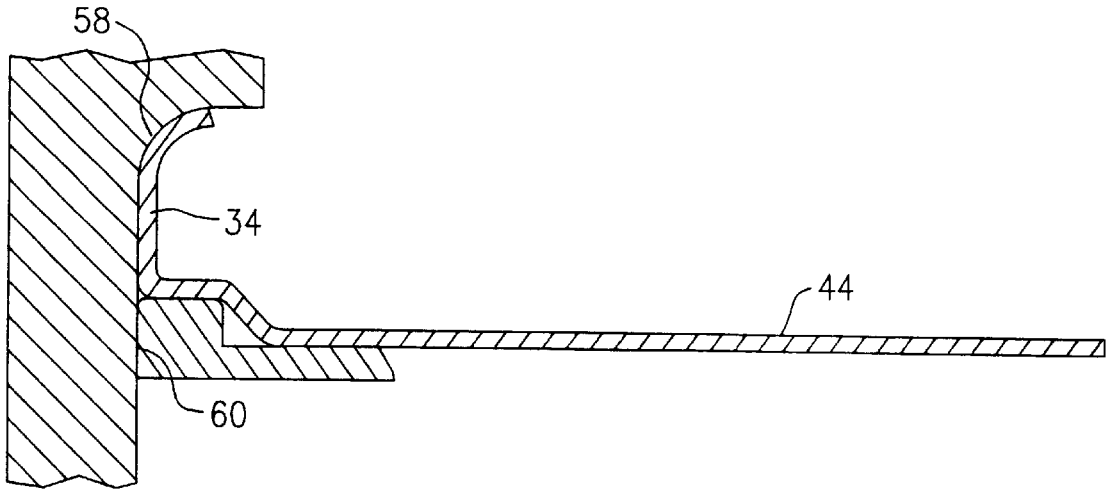
FIGS. 3*a* and 3*b* are two enlarged views of the formation of the fin collar in accordance with the final step of the method of the present invention.
Figure 3B:
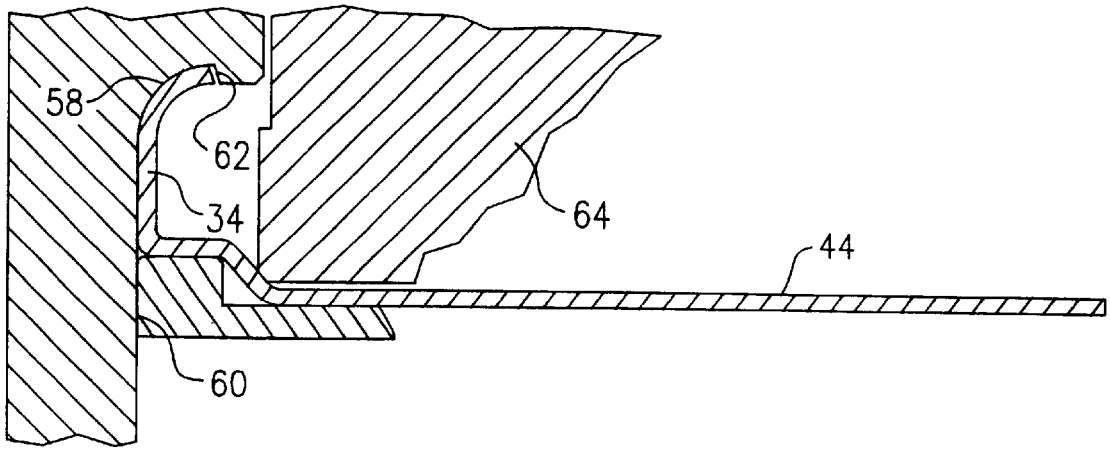

In step 18, pre-fin collar 44 is moved into a radiused under-surface 58 of reflare punch 56. Radiused under-surface 58 is shown more clearly in the enlarged view of the reflare punch in FIG. 3. Under-surface 58 extends from the straight surface 60 of reflare punch 56 preferably to a shoulder 62, which extends in an intersecting path with the radiused under-surface 58. However, the method can be performed well without shoulder 62, yielding reduced manufacturing costs for punch 56. The radius of radiused under-surface 58 will directly effect the straight length of contact leg 22. Accordingly, pre-contact leg 34 of pre-fin collar 44 is positioned against surface 60 and pushed inwardly and upwardly along radiused under-surface 58 until it contacts shoulder 62, or if shoulder 62 is not use, the desired position. The pre-fin collar 44 is moved in this manner via a stripper plate 64 pushing against the stepped transition portion 50 of the pre-fin collar. The pre-fin collar is supported, as shown in FIGS. 1 and 3, by the bottom reflare anvil 57. The length of elongated portion 59 is selected to acquire the optimal positioning of the jog in the transitional stepped portion 50, for fin stacking purposes, and to acquire the desired length of fin portion 70. Stripper plate 64 holds pre-fin collar 44 in and against radiused under-surface 58 and shoulder 62, if used, until pre-contact leg 34 is conformed to the combination of the straight surface 60 and the radiused under-surface 58, of the reflare punch 56.

As a alternative to the method described above, the button forming step 12 can be skipped, thereby starting the process with step 14 and pre-cut fin stock. In this case, since no button forming step is performed, the fin stock begins the piercing step with no button, corner curve 37 conforming to the curved edge 46 of the bottom bushing 36.

In accordance with the steps set forth above and the tooling described, fin collars as shown in FIG. 2 are formed having an elongated and straight tube-contact leg 22, a curved tip portion 68, the stepped transition portion 50, and an elongated fin portion 70.

Referring to FIG. 2, the collar contact height (CH) of this straight tube-contact leg 22 is defined by (1) Collar Leg Height (LH)—Top Radius (TR)—Bottom Radius (BR).

LH is preferably in the range of 0.040 to 0.100 inches. Within this larger LH range, the more preferred ranges of LH include 0.068 to 0.100 inches, with a CH in the range of 0.035 to 0.080 inches, 0.051 to 0.067 inches, with a CH in the range of 0.020 to 0.047 inches, 0.041 to 0.050 inches, with a CH in the range of 0.012 to 0.032 inches, and 0.038 to 0.045 inches, with a CH in the range of 0.008 to 0.024.

TR and Top Width (TW), also defining curved tip portion 68, are preferably in the range of 0.010–0.050 and 0.010–0.060 inches, respectively. BR, BH, and Bottom Width (BW), defining the stepped transition portion 50, are preferably in the range of 0.002–0.025 inches, 0.000–0.010 inches, and 0.010–0.060 inches, respectively. In accordance with these parameters and formation by the above described method, fin collars 20 are provided which have a lengthened contact leg for improved contactability with the heat exchanger tube, wherein the leg is substantially straight due to the process set forth above for achieving improved surface contact.

Depending on the size of the heat exchanger tube, and the specific application of the heat exchanger, these dimensions may be changed.

The primary advantage of this invention is that an improved method is provided for manufacturing heat exchanger fin collars. Another advantage of this invention is that an improved method is provided for manufacturing heat exchanger fin collars with a substantially straight contact leg, for a high level of heat exchanger tube contact with an accompanying improvement in thermal performance and corrosion durability. Still another advantage of this invention is that an improved method is provided for manufacturing heat exchanger fin collars, wherein the method allows for flexibility in the length of the tube-contact leg of the fin-collar. Another advantage of this invention is that an improved heat exchanger fin collar design is provided.

Although the invention has been shown and described with respect to the best mode embodiment thereof, it should be understood by those skilled in the art that the foregoing and various other changes, omissions, and additions in the form and detail thereof may be made without departing from the spirit and scope of the invention.

What is claimed is:

1. A method for manufacturing a heat exchanger with a plate-fin design having a plurality of fin collars, wherein each of the fin collars having an elongated fin portion, a contact leg, a transition portion connecting the contact leg and the fin portion, and a curved contact leg tip, comprising the steps of:

providing a tube and fin stock;

forming a button in the fin stock;

piercing the fin stock and forming a first working collar including a pre fin portion and a pre-contact leg having a first end with a tip;

extruding said first working collar and substantially straightening said pre-contact leg;

abutting said tip against a shoulder of reflaring tooling;

finally straightening said pre-contact leg by pushing said pre-contact leg into said reflaring tooling and against said shoulder for forming the contact leg with a straight tube-contact portion and a curved tip portion, the contact leg having a collar leg height and a collar contact height; and expanding said tube to form an interference fit with the fin collars for attaching the plurality of the fin collars to said tube.

2. The method according to claim 1, wherein the step of piercing includes the step of varying the desired length of the contact leg.

3. The method according to claim 2, wherein said step of varying includes the step of supporting said fin stock in a first direction during said step of piercing over the desired contact leg length.

4. The method according to claim 3, wherein said step of extruding includes forcing the fin stock in a second direction opposite said first direction during the step of supporting.

5. The method according to claim 4, wherein said step of straightening includes the step of supporting the pre-contact leg in a straight orientation during the step of extruding.

6. The method according to claim 4, wherein said step of extruding includes the step of dragging said pre-contact leg along a straight edge for achieving straightening.

7. The method according to claim 5, further including the step of maintaining said pre-contact leg in said straight orientation during the step of finally straightening.

8. The method according to claim 5, wherein the collar leg height is in the range of 0.068 to 0.1 inches and said collar contact height is in the range of 0.035 to 0.080 inches.

9. The method according to claim 5, the collar leg height is in the range of 0.051 to 0.067 inches and said collar contact height is in the range of 0.020 to 0.047 inches.

10. The method according to claim 5, wherein the collar leg height is in the range of 0.041 to 0.05 inches and said collar contact height is in the range of 0.012 to 0.032 inches.

11. The method according to claim 5, wherein the collar leg height is in the range of 0.038 to 0.045 inches and said collar contact height is in the range of 0.008 to 0.024 inches.

12. The method according to claim 5, wherein said collar leg height is in the range of 0.040 to 0.100 inches.

13. A method for manufacturing a heat exchanger with a plate-fin design having a plurality of fin collars, wherein each of the tin collars having an elongated fin portion, a contact leg having a collar leg height and a collar contact height, a transition portion connecting the contact leg and the fin portion, and a curved contact leg tip, comprising the steps of:

providing a tube and fin collar stock;

forming a button in the fin collar stock;

piercing the stock and forming a first working collar including a prefin portion and a pre-contact leg having a first end with a tip;

extruding said first working collar and substantially straightening said pre-contact leg;

finally straightening said pre-contact leg by pushing said pre-contact leg into tooling for forming each of the fin collars with a contact leg having a straight tube-contact portion and a curved tip portion;

expanding said tube to form an interference fit with the fin collars for attaching a plurality of the fin collars to said tube; and reducing the likelihood of galvanic corrosion between the tube and the plurality of fin collars by substantially abutting the straight tube contact portions of the plurality of fin collars on the tube for reducing atmospheric exposure of the tube.

14. The method according to claim 13, wherein the step of finally straightening includes the steps of forming said straight tube contact portion substantially perpendicular to the fin portion, wherein said straight tube contact portion has a collar contact height along which said contact portion contacts the tube, a first curved end portion having a first radius and extending from said first end of said contact portion, and a stepped transitional portion connecting said contact portion and said elongated fin portion, said transitional portion having a second curved end portion having a second radius, said second curved end portion extending from said contact portion opposite said first end.

15. The method according to claim 13, wherein the step of reducing includes the step of decreasing the amount of corrosion enhancing electrolyte seeping between the tube and the fin collars.

16. The method according to claim 14, wherein the collar leg height is in the range of 0.068 to 0.1 inches and said collar contact height is in the range of 0.035 to 0.080 inches.

17. The method according to claim 14, the collar leg height is in the range of 0.051 to 0.067 inches and the collar contact height is in the range of 0.020 to 0.047 inches.

18. The method according to claim 14, wherein the collar leg height is in the range of 0.041 to 0.05 inches and the collar contact height is in the range of 0.012 to 0.032 inches.

19. The method according to claim 14, wherein the collar leg height is in the range of 0.038 to 0.044 inches and the said collar contact height is in the range of 0.008 to 0.024 inches.

20. The method according to claim 14, wherein said collar leg height is in the range of 0.040 to 0.100 inches.

21. The method according to claim 14, wherein the second radius has a size in the range of 0.005 to 0.015 inches.

22. The method according to claim 14, wherein the first radius has a size in the range of 0.015 to 0.040 inches.

* * * * *